US009669964B2

(12) United States Patent
Vogel et al.

(10) Patent No.: US 9,669,964 B2
(45) Date of Patent: Jun. 6, 2017

(54) CONTAINER WITH SHELF AND SCOOP INSERT

(71) Applicant: Gateway Plastics, Inc., Mequon, WI (US)

(72) Inventors: William C. Vogel, Mequon, WI (US); Terrence M. Parve, Menomonee Falls, WI (US)

(73) Assignee: GATEWAY PLASTICS, INC., Mequon, WI (US)

( * ) Notice: Subject to any disclaimer, the term of this patent is extended or adjusted under 35 U.S.C. 154(b) by 34 days.

(21) Appl. No.: 14/245,771

(22) Filed: Apr. 4, 2014

(65) Prior Publication Data

US 2014/0299567 A1 Oct. 9, 2014

Related U.S. Application Data

(60) Provisional application No. 61/809,592, filed on Apr. 8, 2013.

(51) Int. Cl.

| | |
|---|---|
| ***A47G 19/02*** | (2006.01) |
| ***B65D 23/12*** | (2006.01) |
| *B65B 7/28* | (2006.01) |
| *B65D 1/02* | (2006.01) |
| *B65D 51/24* | (2006.01) |
| *B65D 77/24* | (2006.01) |
| *B65B 51/22* | (2006.01) |

(52) U.S. Cl.

CPC ..... *B65D 23/12* (2013.01); *B65D 51/246* (2013.01); *B65B 7/28* (2013.01); *B65B 7/2878* (2013.01); *B65B 51/227* (2013.01); *B65D 1/023* (2013.01); *B65D 51/247* (2013.01); *B65D 77/245* (2013.01); *B65D 2577/205* (2013.01)

(58) Field of Classification Search

CPC ..... B65D 23/12; B65D 1/023; B65D 51/247; B65D 77/245; B65D 51/246; B65D 77/2016; B65D 2577/205; B65B 7/28; B65B 7/2878

USPC .... 220/735, 212, 796, 574, 570; 215/40, 43, 215/44, 391; 206/223, 541; 229/5.5, 401

See application file for complete search history.

(56) References Cited

U.S. PATENT DOCUMENTS

| | | | | | |
|---|---|---|---|---|---|
| 1,734,477 | A * | 11/1929 | Fowle | B65D 51/246 | 206/216 |
| 3,955,742 | A * | 5/1976 | Marshall | B65D 51/247 | 220/270 |
| 5,775,531 | A * | 7/1998 | Lowry | B65D 17/163 | 220/212 |

(Continued)

*Primary Examiner* — Fenn Mathew
*Assistant Examiner* — Elizabeth Volz
(74) *Attorney, Agent, or Firm* — Foley & Lardner LLP

(57) ABSTRACT

A container for storing dispensable contents includes a tub. The tub includes a body having one or more walls extending from a base, an opening, a neck formed around the opening and extending out from the body to form a lip, and a shelf disposed on an inner perimeter of the neck and below the lip. The container also includes a removable insert disposed below the lip and above the contents. The removable insert includes a scoop implement for dispensing the contents, and an outer frame removably coupled to the scoop implement, the outer frame configured to rest on the shelf and support the scoop implement above the contents. The container also includes a closure configured to removably cover the opening.

20 Claims, 10 Drawing Sheets

(56) References Cited

U.S. PATENT DOCUMENTS

| | | | | |
|---|---|---|---|---|
| 6,604,646 | B2 | 8/2003 | Torniainen et al. | |
| 7,464,475 | B2 * | 12/2008 | Tsao | B65D 77/245 215/391 |
| 7,971,747 | B2 | 7/2011 | Blomdahl et al. | |
| 8,042,704 | B2 * | 10/2011 | Borowski | A47J 47/01 220/212 |
| 8,313,001 | B1 * | 11/2012 | Reid | B65D 51/20 215/228 |
| 8,651,311 | B1 * | 2/2014 | Drummond | B65D 77/245 206/223 |
| 2008/0156805 | A1 | 7/2008 | Perry et al. | |
| 2008/0156806 | A1 * | 7/2008 | Perry | B65D 25/2897 220/361 |
| 2008/0156808 | A1 | 7/2008 | Perry et al. | |
| 2011/0042378 | A1 | 2/2011 | Dibnah et al. | |
| 2011/0315686 | A1 | 12/2011 | Siddiqui et al. | |
| 2012/0205376 | A1 | 8/2012 | Yang et al. | |

* cited by examiner

CONTAINER WITH SHELF AND SCOOP INSERT

CROSS-REFERENCE TO RELATED APPLICATIONS

This application claims the benefit of priority to U.S. Provisional Patent Application No. 61/809,592, which was filed on Apr. 8, 2013, the complete disclosure of which is incorporated by reference herein.

BACKGROUND

The present disclosure relates to a container for storing and dispensing matter. The present disclosure more specifically relates to a container having a scoop insert for dispensing contents stored in the neck of the container above the contents. The scoop insert may be nestable to preserve the shape and/or size of the scoop insert during shipping to the container filling location.

Product containers frequently require measuring scoops or other types of implements or utensils for measuring and/or dispensing the product contents stored within the container. Often, the measuring scoops are included with the product container and are immersed within the product contents. With powder-based product contents, such as baby formula, the measuring scoop may settle into the bottom of the product container during shipping and/or storage. In these cases, upon opening the container for the first time, the consumer is forced to manually retrieve the measuring scoop by forcing fingers or other instruments into the product, potentially contaminating the product. Also, the opening of the container is often relatively small, making it more difficult for the consumer to retrieve the measuring scoop.

Typical measuring scoops are often pre-molded at one location and transported separately from the container to the product manufacturing location where containers are filled with product contents. Measuring scoops tend to be easily deformable during shipping and/or transit and no longer have the proper shape to fit the container during product filling operations.

SUMMARY

An embodiment of the present disclosure relates to a container for storing dispensable contents. The container includes a tub. The tub includes a body having one or more walls extending from a base, an opening, a neck formed around the opening and extending out from the body to form a lip, and a shelf disposed on an inner perimeter of the neck and below the lip. The container also includes a removable insert disposed below the lip and above the contents. The removable insert includes a scoop implement for dispensing the contents, and an outer frame removably coupled to the scoop implement, the outer frame configured to rest on the shelf and support the scoop implement above the contents. The container also includes a closure configured to removably cover the opening.

Another embodiment of the present disclosure relates to a removable insert assembly for a container having an opening. The assembly includes two or more removable inserts. Each insert includes an outer frame having a first tier and a step forming a recessed second tier, and a scoop implement removably coupled to the outer frame. In this embodiment, a first removable insert is configured to stack on top of a second removable insert, such that a recessed second tier of the first removable insert rests within a first tier of the second removable insert, a step of the first removable insert being flush with a surface of the first tier of the second removable insert, the first removable insert nests within the second removable insert, and the outer frames of the first and second removable inserts retain their shape.

Another embodiment of the present disclosure relates to a method for filling a container with dispensable contents. The method includes receiving a tub having a neck extending out from a base to form a lip, the neck being formed around an opening with a shelf on an inner perimeter of the neck, filling the tub with dispensable contents to a level below the neck, inserting a removable insert within the neck such that the outer frame rests on the shelf with the removable insert being above the dispensable contents and below the lip, and installing a closure on the neck.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
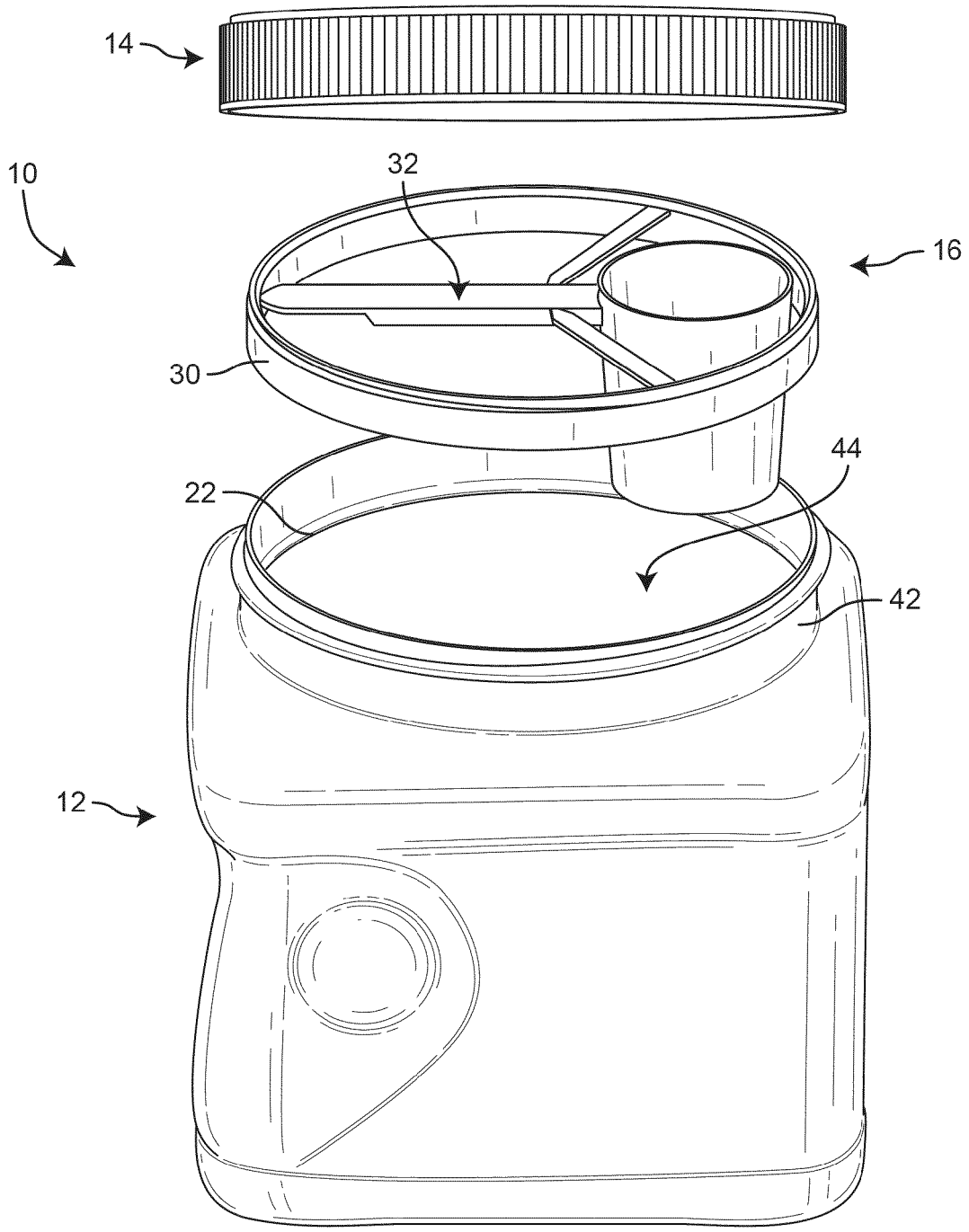
FIG. 1 is an exploded view of a container of the present disclosure, according to an exemplary embodiment.

Referring to FIG. 1, a container 10 of the present disclosure is shown, according to an exemplary embodiment. In this embodiment, the container 10 includes a substantially rectangular tub 12 having an opening 44 (shown according to one embodiment as a circular opening) for filling and accessing the contents of a product stored within the tub 12. The opening 44 is formed to receive a removable scoop insert 16 that rests upon a shelf 22 formed around the inside perimeter of a neck 42 formed around the opening 44. The scoop insert 16 is sized and shaped to fit the opening 44 and includes a scoop implement 32 that is removably coupled to an outer frame 30 (e.g. collar, band, ribbon, etc.). The outer frame 30 is shown as a ring in FIG. 1, sized and shaped to rest on the shelf 22 so that the scoop insert 16 fits securely within the opening 44 and above the product contents until ready for use in dispensing the product contents. The container 10 also includes a closure 14 that fits over the opening 44, sealing the container 10 without interference from the scoop insert 16.

Figure 2:
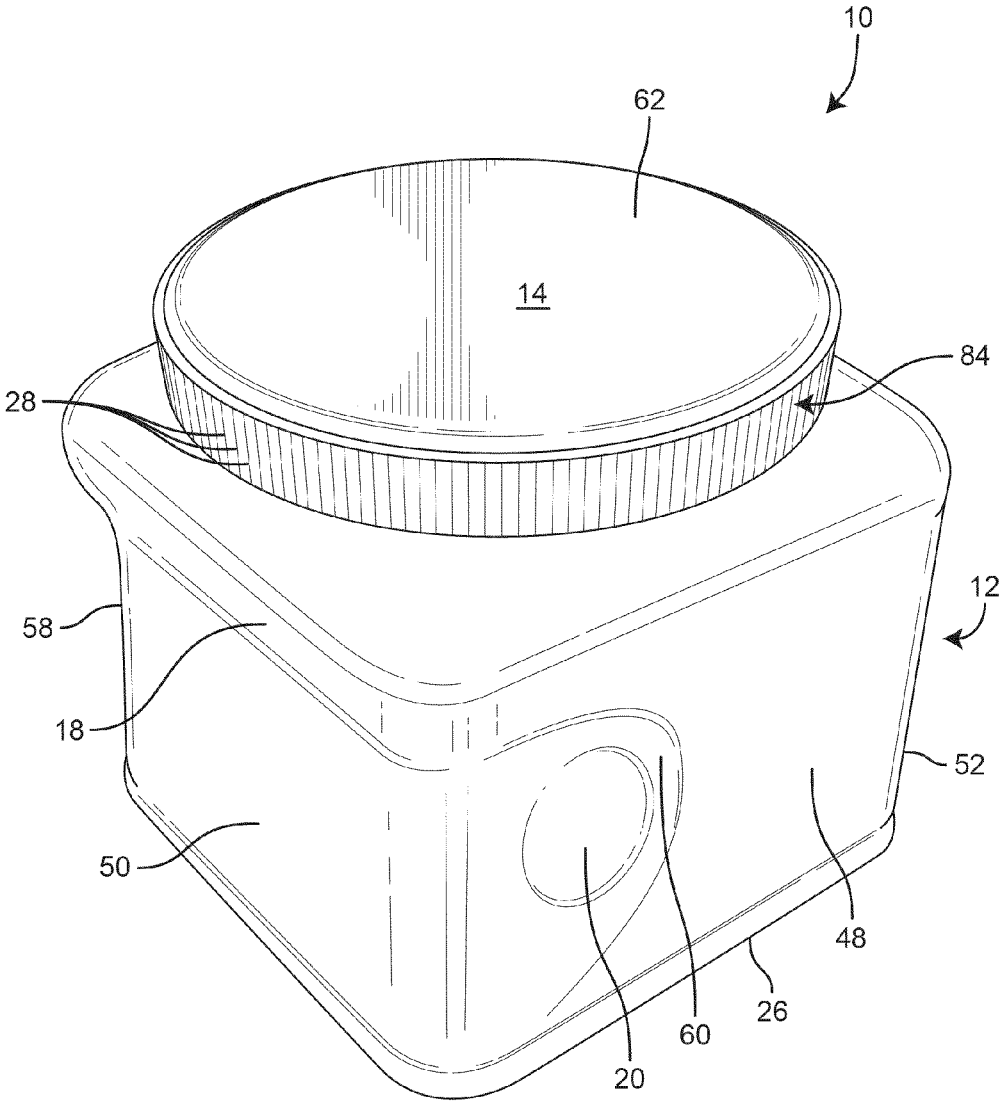
FIG. 2 is a perspective view of the container of FIG. 1, according to an exemplary embodiment.

Referring now to FIG. 2, the container 10 is shown in a closed configuration, according to an exemplary embodiment. In this embodiment, the tub 12 includes a body portion shown to include four substantially vertical walls 48, 50, 52, and 58 coupled to a flat bottom surface 26 (e.g. base, floor, etc.) in a substantially rectangular configuration to maximize shelf placement density. The wall 48 is connected on a first side to wall 50 and on a second side to wall 52. The walls 50 and 52 each extend perpendicularly from wall 48 to connect to wall 58. Wall 58 is substantially parallel to wall 48 and perpendicular to the walls 50 and 52 such that the four walls 48, 50, 52, and 58 form a substantially rectangular shape. The bottom surface 26 is rectangular in shape. The bottom surface 26 is connected to walls 48, 50, 52, and 58, and is positioned perpendicular to walls 48, 50, 52, and 58, forming the bottom of the rectangular tub 12.

The wall 48 includes a curved indent 60 formed on the side of the wall 48 closest to wall 50. A round dimple 20 is formed within the indent 60. The indent 60 is formed and positioned to receive the hand of a consumer so that the tub 12 may be more easily manipulated by the consumer. The dimple 20 is sized to receive a thumb or forefinger so that the consumer may more easily grip the tub 12. In an exemplary embodiment, the wall 58 mirrors the wall 48, having an indent (not shown) and a dimple (not shown) mirroring the indent 60 and the dimple 20 of wall 48 (i.e. positioned on the side of wall 58 closest to wall 50). In this embodiment, the consumer may grip the container 10 with a right hand, having a thumb on the dimple (not shown) of wall 58 and a forefinger on the dimple 20 of wall 48. Alternatively, the consumer may grip the container 10 with a left hand, having a thumb on the dimple 20 of wall 48 and a forefinger on the dimple of wall 58. A ledge 18 runs along the top side of the wall 50 from the wall 48 to the wall 58. The ledge 18 protrudes a distance out from the wall 50 such that the ledge 18 provides a stop intended to prevent the container 10 from slipping through the hand of the consumer as the consumer grips the container 10.

In the illustrated embodiment of FIG. 2, the container 10 is shown with the closure 14 covering the opening 44 to seal the container 10. The closure 14 is circular in this embodiment, being sized and shaped to fit the circular opening 44, but may have another shape (e.g. square, rectangular, octagonal, etc.) in other embodiments. The closure 14 is installed or removed by rotating the closure 14 over the opening in a clockwise or counter-clockwise direction, respectively, relative to the tub 12. In an exemplary embodiment, the closure 14 includes a retaining feature shown in FIG. 9 as threads 54 and configured to engage mating threads 24 (shown in FIG. 3) on the neck 42 of the tub 12 and around the opening 44. The threads 54 may mate with the threads 24 of the tub 12 as the closure 14 is rotated clockwise over the opening, forming a seal. As the closure 14 is rotated counter-clockwise, the threads 54 and 24 disengage from each other, allowing the closure 14 to be removed from the container 10. In other embodiments, the closure 14 may have other retaining features for forming a seal over the opening 44. The closure 14 includes a plurality of ridges 28 (e.g. projections, protrusions, etc.) formed on outer edge 84 of the closure 14. The ridges 28 are positioned vertically on the outer edge 84 (according to FIG. 2), evenly spaced around the outer perimeter of the closure 14. The ridges 28 are intended to provide a gripping surface for the consumer when manipulating the closure 14 to open or close the container 10. The closure 14 also has a flat top surface 62 so that containers 10 may be stacked on top of each other or another product may be safely stacked on top of the container 10.

Figure 3:
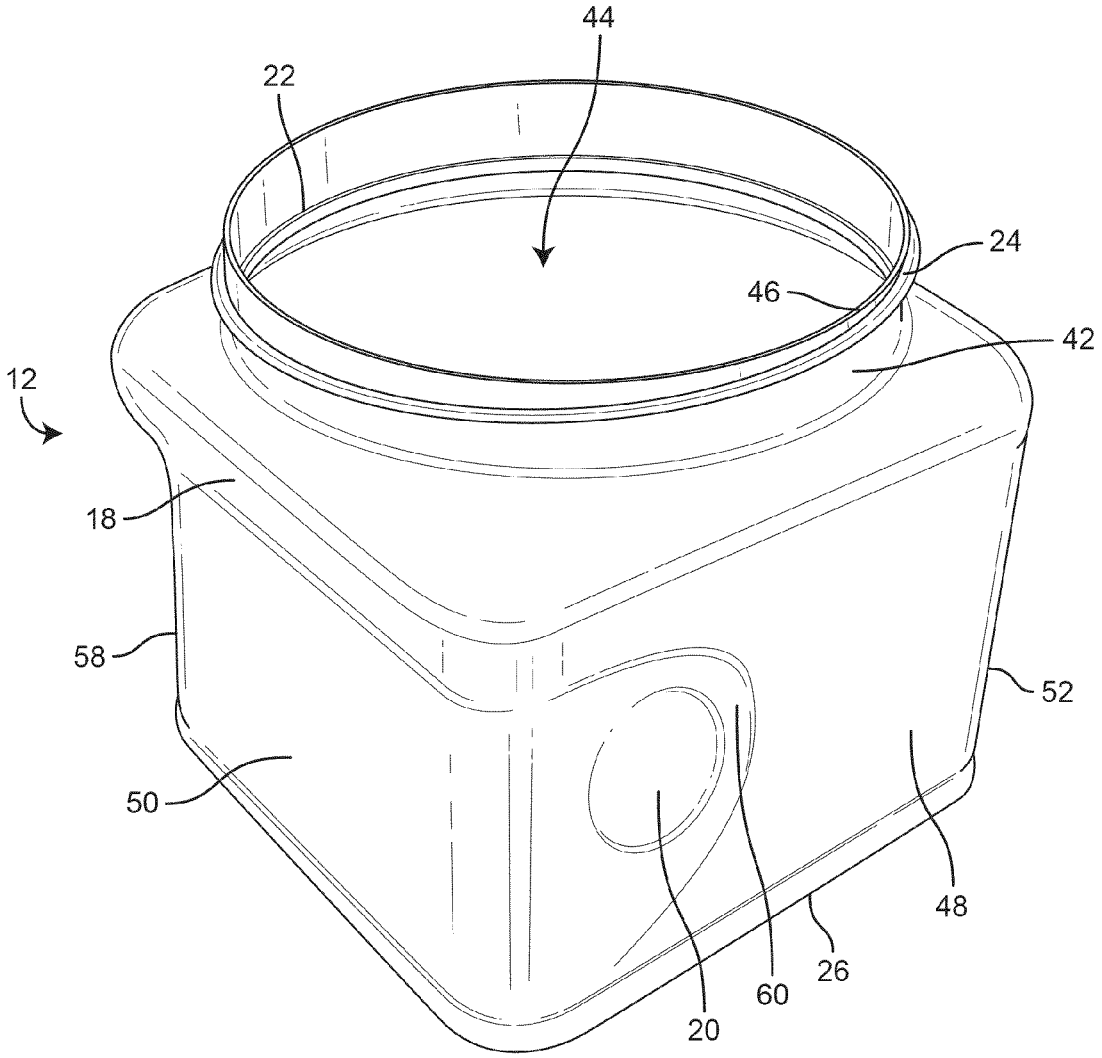
FIG. 3 is a perspective view of a body portion of the container of FIG. 1, according to an exemplary embodiment.

Referring now to FIG. 3, the tub 12 is shown, according to an exemplary embodiment. In this embodiment, the tub 12 is shown to include neck 42 for receiving the closure 14. The neck 42 is formed by a continuous upright edge having a circular shape and extending around the perimeter of the opening 44. Threads 24 are positioned on the neck 42 for mating with the threads 54 (shown in FIG. 9) of the closure 14 to form a seal. In an exemplary embodiment, the neck 42 forms the shape of the opening 44. In some embodiments, the neck 42 may form another shape (e.g. rectangular, octagonal, irregular, etc.) suitable for the particular application of the container 10. The neck 42 extends out to a lip 46 that forms a rounded edge of the neck 42.

The neck 42 further includes shelf 22 positioned on an inside portion of the neck 42. The shelf 22 (e.g. protrusion, ledge, lip, stop, etc.) has a circular profile, extending around the inner perimeter of the neck 42. The shelf 22 is raised from the surface of the neck 42, extending inwardly from the neck 42 toward the opening 44. In an exemplary embodiment, the shelf 22 extends a distance from the neck 42 such that the shelf 22 forms a stop for the outer frame 30 of the scoop insert 16, allowing the scoop insert 16 to rest on the shelf 22 within the neck 42 of the tub 12. In this embodiment, the shelf 22 is intended to prevent the scoop insert 16 from falling into the product within the container 10. The size of the shelf 22 is directly related to the size of the outer frame 30 of the scoop insert 16, such that the shelf 22 is large enough to allow the scoop insert 16 to rest on the shelf 22 without dropping into the tub 12. The shelf 22 may be continuous (as shown in FIG. 3), extending around the inner perimeter of the neck 42, or the shelf 22 may be segmented, having individual segments positioned strategically within the opening 44 such that the segments of the shelf 22 hold up the scoop insert 16 and prevent the scoop insert 16 from falling into the product contents. The position of the shelf 22 on the neck 42 is such that the scoop insert 16 rests below the lip 46 of the tub 12 in order to facilitate placement of a sealing lid (e.g. layer, liner, seal, etc.) on the lip 46. The placement of the sealing lid follows the placement of the product contents, and then the scoop insert 16, into the container 10.

The rectangular shape of the tub 12 in the illustrated embodiment of FIG. 3 may allow the container 10 to maximize product shipping and display density. The surfaces of the vertical sides (e.g. walls 48, 50, 52, 58, etc.) are configured to abut against each other with little space in between the containers 10 while resting on a shelf or within a crate or other type of large storage or shipping container. Likewise, the flat top surface 62 may allow the containers 10 to be stacked on top of each other in order to minimize the space utilized to display the containers 10. In other embodiments the tub 12 may be another shape suitable for the particular application of the container 10. For instance, the tub 12 may have a round or spherical shape with a flat bottom surface 26. The tub 12 may also have any number of vertical sides suitable for the particular container 10 or product. Also, the opening 44 is shown to be circular in shape, but may be another shape in other embodiments. The opening 44 may be rectangular in some embodiments to approximate the shape of the tub 12. In other embodiments, the opening 44 may have a shape not matching the shape of the tub 12, or the opening 44 may be another shape suitable for the particular application of the container 10.

Figure 4:
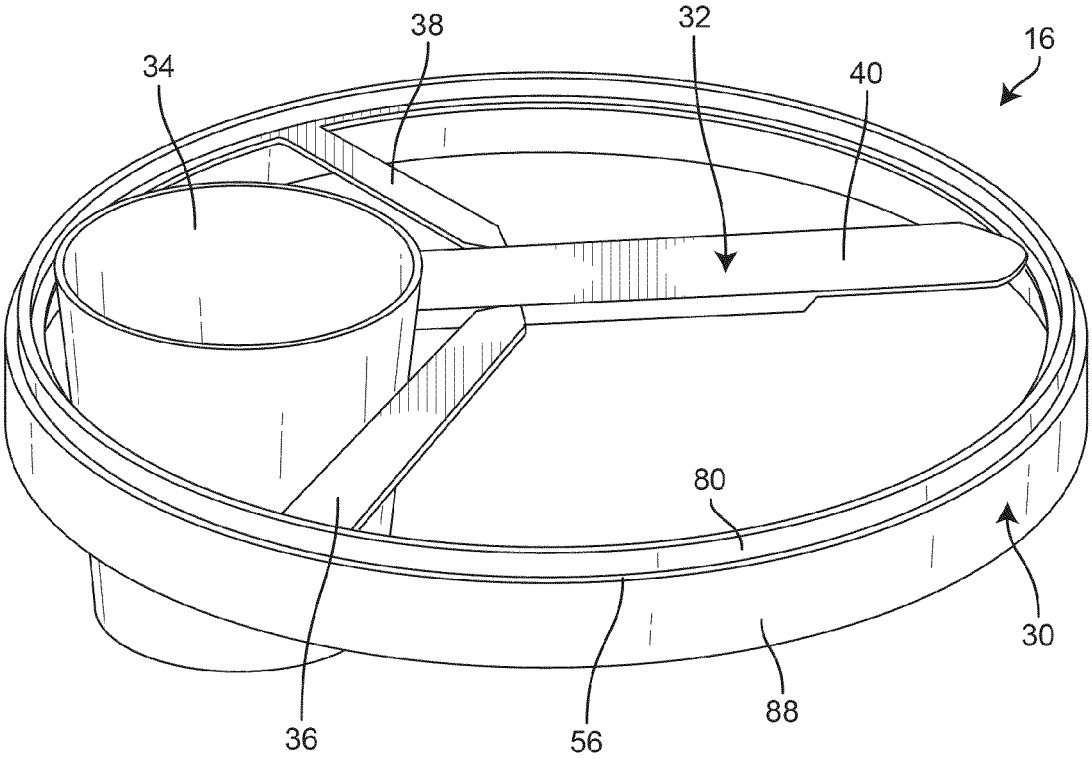
FIG. 4 is a perspective view of a scoop insert for the container of FIG. 1, according to an exemplary embodiment.

Referring now to FIG. 4, a scoop insert 16 is shown, according to an exemplary embodiment. In this embodiment, the scoop insert 16 includes a scoop implement 32 removably coupled to outer frame 30 and having a scoop portion 34 and a handle portion 40. The scoop portion 34 has a round shape in the illustrated embodiment of FIG. 4, but the scoop portion 34 may have another shape (e.g. square, rectangular, octagonal, etc.) suitable for the particular application in other embodiments. The handle portion 40 is connected to the scoop portion 34 and configured to allow the consumer to grip the scoop implement 32. The scoop implement 32 may be used to scoop the product contents from the container 10 so that the product may be measured and/or dispensed.

The scoop implement 32 is coupled to the outer frame 30 of the scoop insert 16 by frangible connecting strips 36 and 38. In the illustrated embodiment of FIG. 4, the connecting strips 36 and 38 are removably coupled on a first end to opposite sides of the handle portion 40, and coupled on a second end to the outer frame 30. In this embodiment, the connecting strips 36 and 38 are removably coupled to the handle portion 40 such that the consumer may de-couple the scoop implement 32 from the connecting strips 36 and 38 by manipulating the scoop implement 32 and/or the connecting strips 36 and 38 until the connecting strips 36 and 38 break off from the scoop implement 32 (i.e. the material connecting the strips 36 and 38 to the scoop implement 32 is compromised such that the connecting strips 36 and 38 are no longer connected to the scoop implement 32). In an exemplary embodiment, the connecting strips 36 and 38 remain coupled to the outer frame 30 so that the scoop implement 32 is more easily removable from the connecting strips 36 and 38. The outer frame 30 may also include two connectors 64 (shown in FIG. 7) that removably couple the scoop portion 34 of the scoop implement 32 to the outer frame 30. The connectors 64 may be broken or otherwise manipulated (e.g. twisted, cut, etc.) in order to de-couple the scoop portion 34 from the outer frame 30.

The scoop implement 32 may be removed from the scoop insert 16 by twisting the scoop implement 32 away from the connecting strips 36 and 38 and connectors 64, or by otherwise manipulating the scoop implement 32, the connecting strips 36 and 38, and/or the connectors 64 (e.g. cutting or twisting the strips 36 and 38 and/or connectors 64, etc.). The connectors 64 and the connecting strips 36 and 38 are intended to prevent the scoop implement 32 from falling from the scoop insert 16 into the product container 10. Once the scoop implement 32 is removed from the outer frame 30 as described above, the scoop implement 32 may be used to measure and/or dispense the product contents stored within the container 10. In an exemplary embodiment, the outer frame 30, connecting strips 36 and 38, and the connectors 64 are readily disposable and recyclable.

Although the outer frame 30 for the scoop insert 16 is shown to be circular in shape to match the size and shape of the opening 44, in other embodiments the scoop insert 16 may be another shape or size to fit an opening 44 having another shape and/or size. In still other embodiments, the scoop insert 16 is not be sized or shaped to fit the opening 44, but may be sized and/or shaped to nest within the neck 42 of the container 10. In exemplary embodiments, the scoop insert 16 is sized and shaped to mate with the shelf 22 so that the scoop insert 16 nests within the neck 42 and below the lip 46 of the container 10. The scoop insert 16 may also include other connectors for connecting the scoop implement 32 to the outer frame 30, or may have zero connectors (e.g. the scoop implement 32 may be attached directly to the outer frame 30 by frangible links, etc.) in other embodiments.

Figure 5:
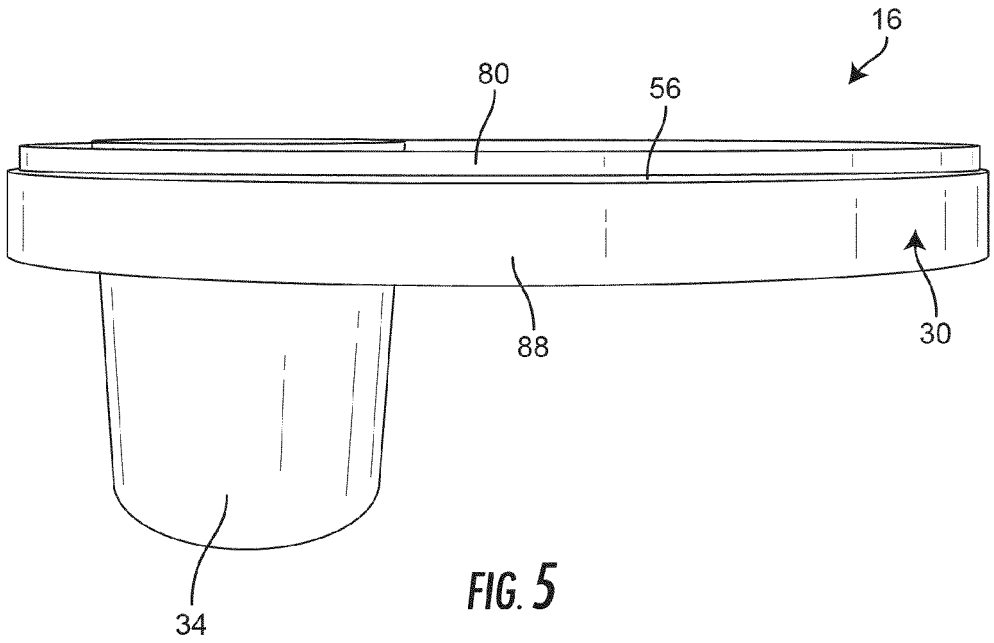
FIG. 5 is a side view of the scoop insert of FIG. 4.

Referring to FIGS. 4 and 5, the scoop insert 16 includes a first tier 88 and a recessed second tier 80. The first tier 88 forms the bottom portion and the second tier 80 forms the top portion of the outer frame 30 (according to FIG. 4). The tiers 88 and 80 are connected by a step 56 forming a top surface of the first tier 88. In an exemplary embodiment, the step 56 allows two or more scoop inserts 16 to be stacked (i.e. nest) on top of each other (shown in further detail in FIG. 10), so that the scoop inserts 16 are more easily manufactured and/or shipped. In some embodiments, for instance, the scoop inserts 16 are made from a thin and lightweight molded material which may deform in response to certain conditions (e.g. exposure to heat, an external force, etc.). If the shape of the scoop insert 16 is deformed, the scoop insert 16 may not be compatible with the automated process used to package the container 10. The scoop inserts 16 are therefore configured to be stacked or nested on top of each other when manufactured and/or shipped so that each scoop insert 16 holds its shape and in order to maximize the storage and shipping density of the scoop inserts 16. The second tier 80 is configured to mate with the first tier of a second scoop insert 86 (shown in FIG. 10). The second tier 80 is shaped and sized to rest within a first tier of the second scoop insert 86 such that the step 56 contacts the bottom of the first tier of the second scoop insert 86, nesting two or more scoop inserts 16 and/or 86. The interaction between two or more nested scoop inserts 86 and/or 16 is shown more particularly in FIG. 10.

Figure 6:
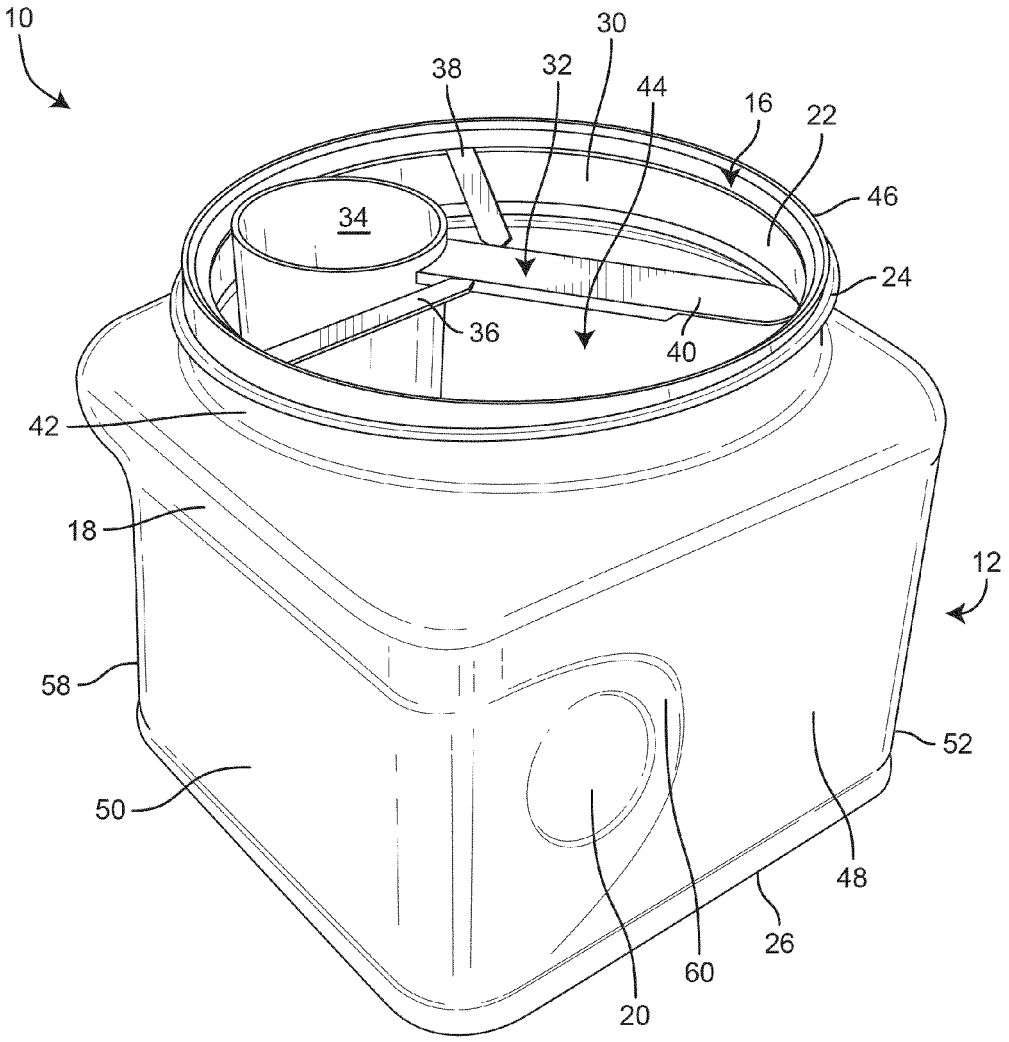
FIG. 6 is a perspective view of the scoop insert of FIG. 1 mated with the tub of FIG. 3, according to an exemplary embodiment.
Figure 7:
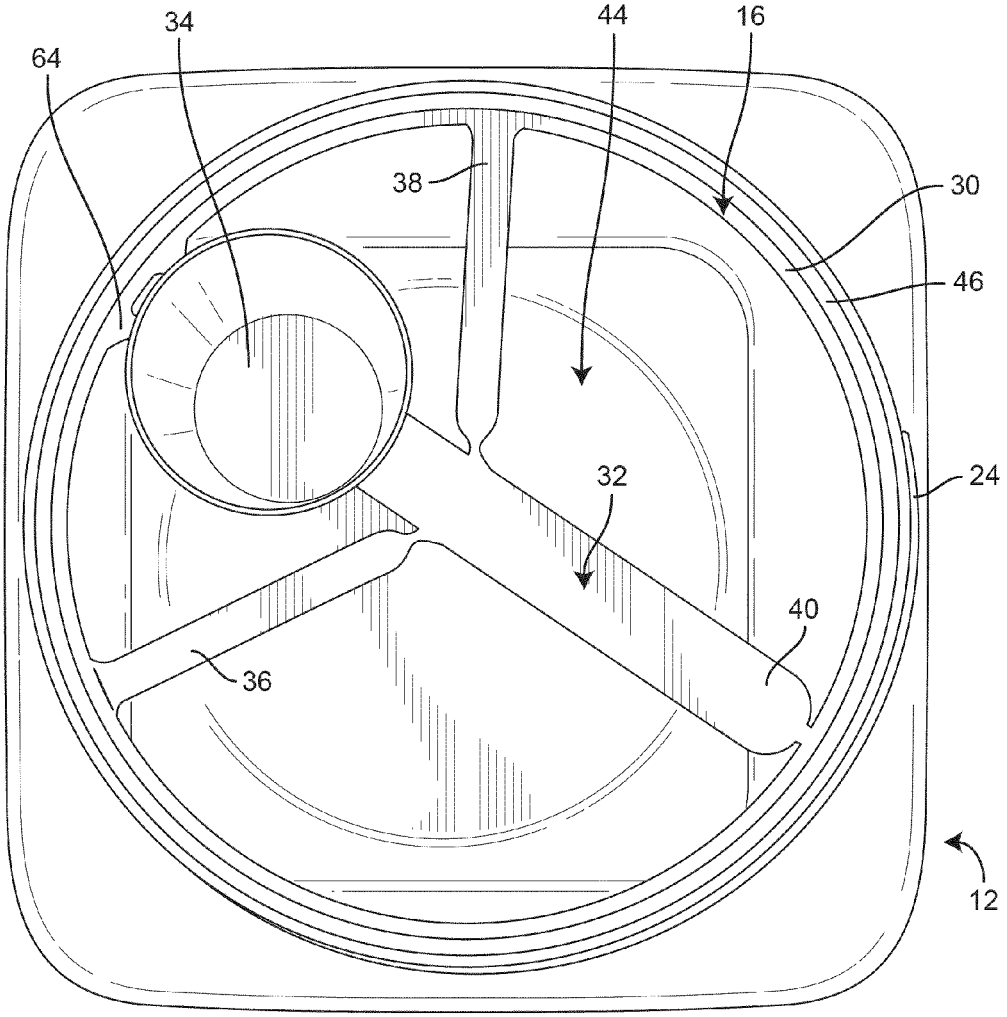
FIG. 7 is a top view of the tub and scoop insert of FIG. 6.

Referring now to FIGS. 6 and 7, the scoop insert 16 fits within the opening 44, resting on the shelf 22 and just below the lip 46 formed around the opening 44. The scoop insert 16 is removable so that the scoop insert 16 may be isolated (as shown in FIGS. 4 and 5) and more easily manipulated. For instance, the scoop insert 16 may be removed from the container 10 in order to removed the scoop implement 32 from the scoop insert 16 for use to measure and/or dispense the product. In an exemplary embodiment, the scoop insert 16 is removed from the opening 44 upon first use of the container 10. Once removed from the container 10, the scoop implement 32 may be removed from the scoop insert 16 by manipulating the connectors 64 and connecting strips 36 and 38. The scoop implement 32 may be easier to remove from the scoop insert 16 once the scoop insert 16 is removed and isolated from the container 10.

The scoop insert 16 rests on a shelf 22 within the opening 44 of the tub 12, and is positioned within the opening 44 such that the cavity of the scoop portion 34 faces up. The scoop insert 16 is shown in a particular orientation in FIGS. 6 and 7, but in other embodiments the scoop insert 16 may be rotated to the left or to the right to another orientation relative to the tub 12. The outer frame 30 is sized and shaped to fit within the opening 44, resting on the shelf 22 formed on the inside portion of the neck 42. The shelf 22 is positioned such that the outer frame 30 and the rest of the scoop insert 16 rest below the lip 46 of the opening 44. In this way, the closure 14 fits over the opening 44 without interfering with the scoop insert 16, allowing the closure 14 to form a seal over the container 10. The closure 14 mates with the threads 24 positioned on the neck 42, sealing the container 10.

In an exemplary embodiment, the container 10 may also include a thin lid (e.g. layer, liner, etc.) (not shown) that is pressed over the opening 44 and positioned between the scoop insert 16 and the closure 14. In this embodiment, the lid fits over the lip 46 of the opening 44, and the scoop insert 16 rests in a position below the lid. The lid (not shown) may cover the opening 44 and the scoop insert 16. In some embodiments, the lid includes an adhesive that is activated by heat and positioned around the edge of the lid to inductively seal the container 10. In these embodiments, heat may be applied to the container 10, activating the adhesive and causing the lid to form an induction seal over the opening 44, protecting the product within the container 10 from contamination. The scoop insert 16 may nest within the neck 42 of the tub 12 and below the lid, such that the lid is allowed to contact the lip 46 and form a seal. The lid may be made from a foil material, a plastic material, or another material configured to cover the opening 44 and/or protect the contents of the container 10 from contamination.

Figure 8:
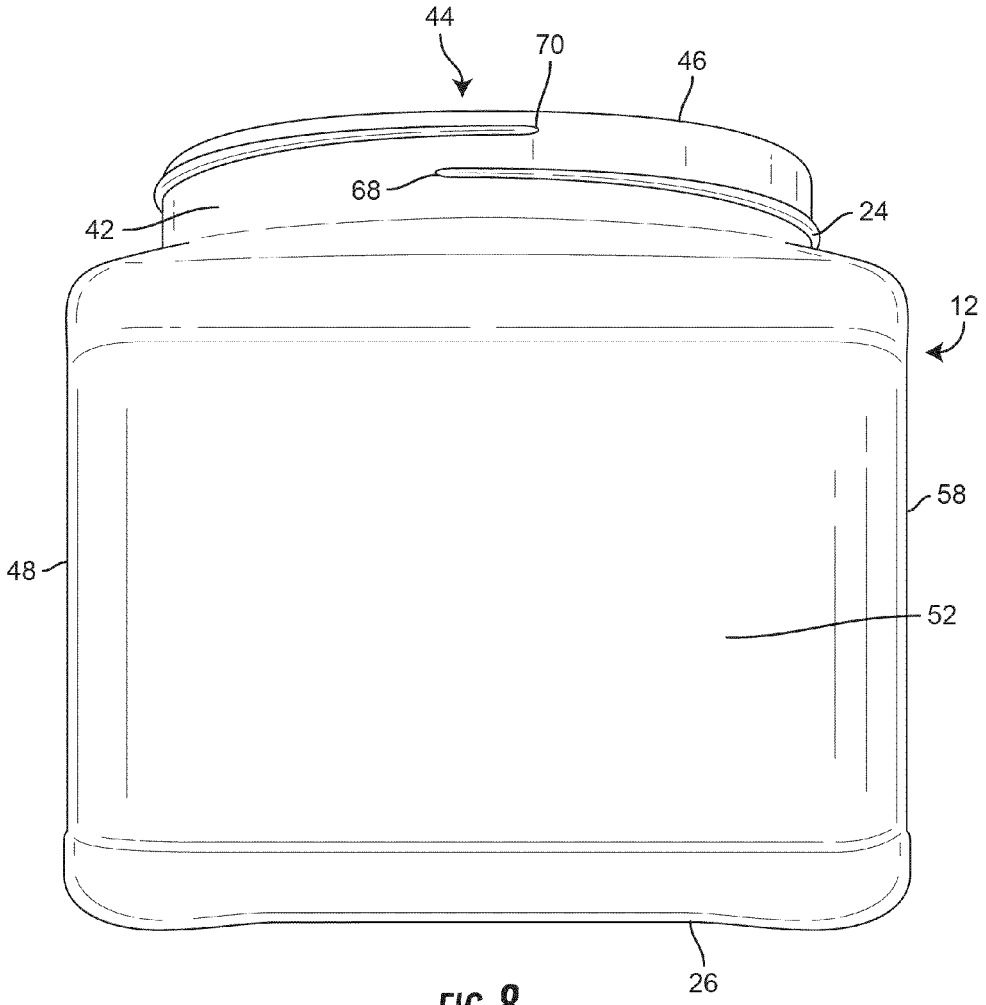
FIG. 8 is a side view of the tub of FIG. 3.
Figure 9:
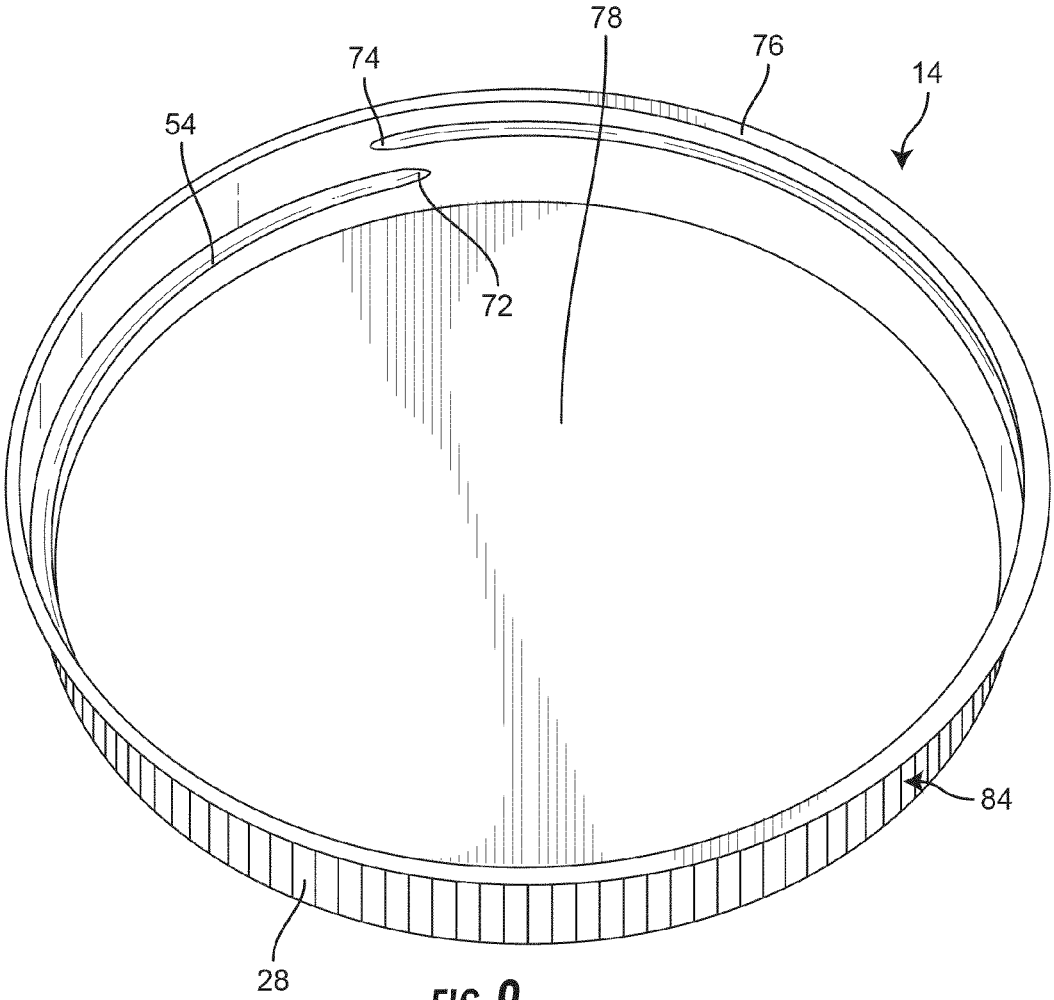
FIG. 9 is a bottom perspective view of a closure for the container of FIG. 1, according to an exemplary embodiment.

Referring to FIGS. 8 and 9, the threads 24 and 54 are shown more particularly. In the illustrated embodiment of FIG. 8, the threads 24 are formed by a single ribbon (i.e. band, ridge, etc.) of plastic material wrapped around the neck 42 of the tub 12. In this embodiment, the threads 24 are made from the same material as the tub 12. However, in other embodiments the threads 24 and the tub 12 may be made from materials other than plastic, and the threads 24 may be made from a different material than the material of the tub 12. The threads 24 are raised from the neck 42 in order to mate with the threads 54 (shown in FIG. 9) of the closure 14. In this embodiment, the threads 24 have a first end 68 that is positioned at the approximate midpoint between a bottom 66 of the neck 42 and the lip 46. The threads 24 wrap around the outer perimeter of the neck 42 at a slight elevation relative to the bottom 66 and ending at a second end 70 near the lip 46 of the tub 12.

Referring further to FIG. 9, threads 54 are formed on the inside of the closure 14. The threads 54 are similar to the threads 24, being formed by a single ribbon of plastic material wrapped along the inside of the closure 14. In an exemplary embodiment, the threads 54, closure 14, threads 24, and tub 12 are made from the same plastic material. However, in other embodiments, the threads 54 and closure 14 may be made from another material suitable for the application of the container 10, and the threads 54 and closure 14 may be made from different materials. The threads 54 are raised from the closure 14 in order to mate with the threads 24. In this embodiment, the threads 54 have a first end 72 that is positioned at an approximate midpoint between an outer edge 76 of the closure 14 and an inner face 78 of the closure 14. The threads 54 wrap around the inner perimeter of the closure 14 at a slight elevation ending at a second end 74 near the outer edge of the closure 14. The threads 54 are configured to mate with the threads 24, with the closure 14 forming a seal over the opening 44 of the tub 12.

In an exemplary embodiment, the closure 14 includes a foil lid that may form a seal over the opening 44 of the tub 12. The foil lid may be positioned on the inner face 78 of the closure 14, such that the foil lid contacts the lip 46 when the closure 14 is fully seated over the opening 44 of the tub 12. In some embodiments, heat may be applied to the container 10, causing the foil lid to form an induction seal over the opening 44 and protecting the product within the container 10 from contamination. In these embodiments, the scoop insert 16 nests within the neck 42 of the tub 12 and below the foil lid, such that the foil lid is allowed to contact the lip 46 and form a seal.

Figure 10:
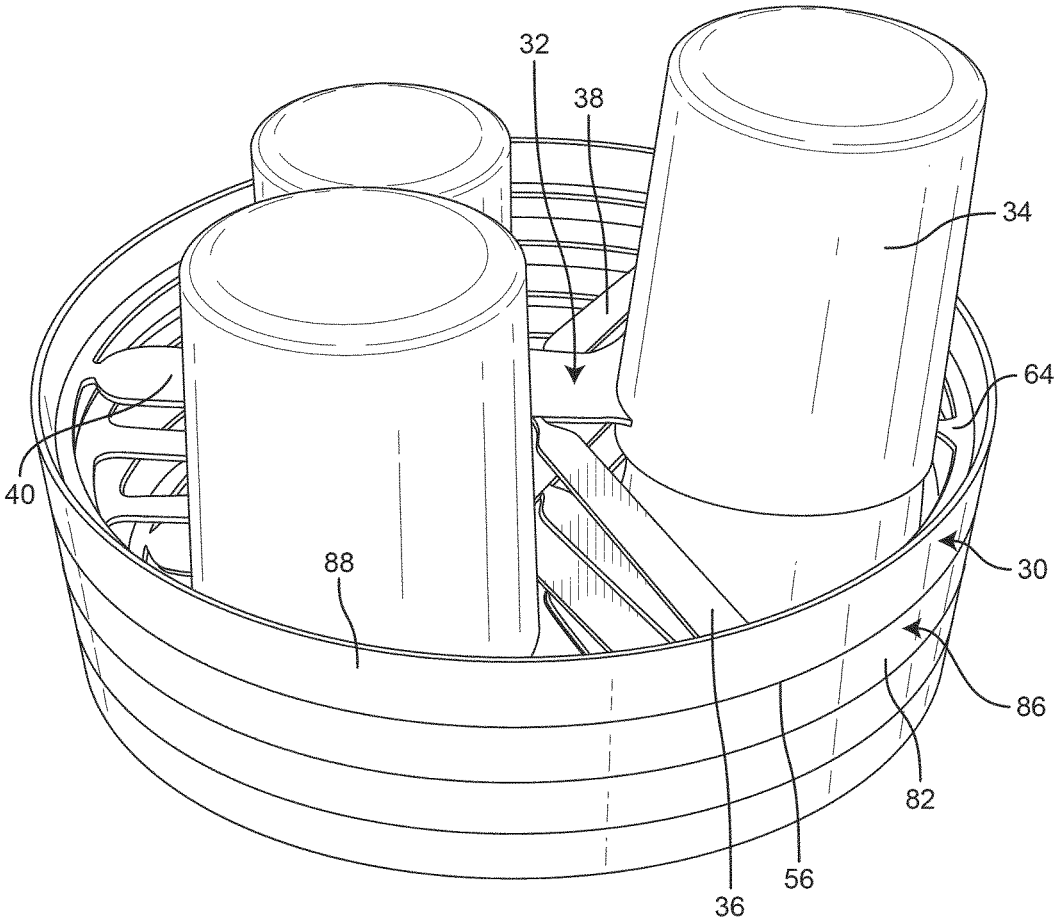
FIG. 10 is a perspective view of a plurality of nested and stacked scoop inserts, according to an exemplary embodiment.

Referring now to FIG. 10, removable scoop inserts 16 are shown stacked on top of each other as a removable insert assembly, according to an exemplary embodiment. Scoop inserts 16 may be configured to stack on top of and nest with each other so that the outer frames 30 of the scoop inserts 16 retain their shape during shipping and/or storage. For instance, in some embodiments the scoop inserts 16 are manufactured by a heated molding process. In these embodiments, the scoop inserts 16 may be stacked and nested in a removable insert assembly at the end of the molding process in order to cool the scoop inserts 16 while retaining their shape. In the illustrated embodiment of FIG. 10, the scoop insert 16 has a circular outer frame 30. By nesting the scoop insert 16 within second scoop insert 86 while the molded scoop inserts 16 and 86 are cooled, the scoop inserts 16 and 86 may maintain the shapes of circular outer frames 30 and 82. The scoop insert 16 may also be nested with another scoop insert during shipping and/or storage, or during another time before the scoop insert 16 is inserted into the container 10. If the scoop insert 16 does not retain its shape (i.e. the shape of the outer frame 30 is irregular), the outer frame 30 may not fit properly within the circular neck 42 during an automated production process for assembling the container 10. As a result, the automated production process may be interrupted and the irregular scoop insert may be scrapped and replaced with another scoop insert that is suitable for use with the container 10.

Referring again to the illustrated embodiment of FIG. 10, the outer frame 30 of the scoop insert 16 rests flat on a surface when placed in the orientation of FIG. 10 (i.e. having the cavity of the scoop portion 34 facing down, or the scoop insert 16 being upside down relative to the intended orientation of FIG. 6 when within the container 10). In an exemplary embodiment, the outer frame 30 of a first scoop insert 16 is configured to mate with an outer frame 82 of second scoop insert 86. As shown in FIG. 4, outer frame 30 includes step 56 formed on the outer edge of the outer frame 30, providing the outer frame 30 with a recessed second tier 80. The second tier 80 is configured to mate with a first tier of the outer frame 82, such that the first tier of the outer frame 82 contacts the step 56. A surface of the first tier of the outer frame 82 may be flush with the step 56 in an exemplary embodiment. In FIG. 10, the second tier 80 is hidden from view by outer frame 82, mating with outer frame 82 such that the second tier 80 rests within the outer frame 82.

It is also important to note that the construction and arrangement of the elements of the container as shown in the exemplary embodiment is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements and those shown a multiple parts may be integrally formed. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

Before discussing further the details of the closure and components thereof, it should be noted at the outset that references to "front," "back," "rear," "upper," "lower," "right," and "left" in this description are merely used to identify the various elements as they are oriented in the FIGURES, with "front," "back," and "rear" being relative to the position of the closure when secured to a container. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

What is claimed is:

1. A container for storing dispensable contents, the container comprising:

a tub, comprising:

a body having one or more walls extending from a base; an opening;

a neck formed around the opening and extending out from the body to form a lip; and a shelf formed on and extending from an inner perimeter surface of the neck, the shelf disposed entirely below the lip;

a removable scoop insert disposed entirely below the lip, and above the contents, the removable scoop insert comprising:

a scoop implement for dispensing the contents; and an annular outer frame releasably coupled to the scoop implement, the annular outer frame configured to rest on the shelf and support the scoop implement above the contents; and a closure configured to removably cover the opening.

2. The container of claim 1, wherein the shelf is continuous, extending around the inner perimeter of the neck.

3. The container of claim 1, wherein the shelf is segmented.

4. The container of claim 1, wherein the tub has a substantially rectangular shape, such that the vertical walls of two or more tubs are configured to abut against each other when resting on their respective bases.

5. The container of claim 1, wherein the annular outer frame is sized and shaped to fit the opening.

6. The container of claim 1, wherein the annular outer frame has a substantially circular shape.

7. The container of claim 1, wherein the removable scoop insert further comprises frangible strips releasably coupling the scoop implement to the outer frame.

8. The container of claim 1, wherein the annular outer frame of the removable scoop insert comprises a first tier and a recessed second tier, the second tier connected to the first tier by a step forming a top surface of the first tier, wherein the second tier fits within a first tier of a second of the outer frame such that the step contacts a bottom surface of the first tier of the second outer frame, nesting the outer frame within the second outer frame.

9. The container of claim 1, wherein the tub comprises an indent formed to receive the hand of a consumer so that the tub is more easily manipulated by the consumer.

10. The container of claim 1, further comprising a lid attached to the lip and forming a seal over the opening, the lid being positioned above the removable scoop insert such that the removable scoop insert is disposed entirely below the lid.

11. The container of claim 10, wherein the lid comprises an adhesive that is activated by heat and positioned around the edge of the lid to inductively seal the container.

12. The container of claim 10, wherein the tub comprises a first set of retaining threads, and the closure comprises a second set of retaining threads for mating with the first set of retaining threads to cover the lid.

13. A container for storing dispensable contents, the container comprising:

a tub, comprising:

a body having one or more walls extending from a base; an opening;

a neck formed around the opening and extending out from the body to form a lip; and a shelf formed on and extending from an inner perimeter surface of the neck, the shelf disposed entirely below the lip;

a removable insert disposed entirely below the lip, and above the contents, the removable insert comprising:

a scoop implement for dispensing the contents; and an outer frame removably coupled to the scoop implement, the outer frame configured to rest on the shelf and support the scoop implement above the contents; and a closure configured to removably cover the opening;

wherein the outer frame of the removable insert comprises a first tier and a recessed second tier, the second tier connected to the first tier by a step forming a top surface of the first tier, wherein the second tier fits within a first tier of a second of the outer frame such that the step contacts a bottom surface of the first tier of the second outer frame, nesting the outer frame within the second outer frame.

14. The container of claim 13, wherein the shelf is continuous, extending around the inner perimeter of the neck.

15. The container of claim 13, wherein the shelf is segmented.

16. The container of claim 13, wherein the tub has a substantially rectangular shape, such that the vertical walls of two or more tubs are configured to abut against each other when resting on their respective bases.

17. The container of claim 13, wherein the outer frame is sized and shaped to fit the opening.

18. The container of claim 13, wherein the outer frame has a substantially circular shape.

19. The container of claim 13, wherein the removable insert further comprises frangible strips removably coupling the scoop implement to the outer frame.

20. The container of claim 13, wherein the tub comprises an indent formed to receive the hand of a consumer so that the tub is more easily manipulated by the consumer.

* * * * *